US005620266A

United States Patent [19]

Kim

[11] Patent Number: 5,620,266

[45] Date of Patent: Apr. 15, 1997

[54] METHOD FOR OPTIMALLY CONTROLLING SERIAL PRINTER CARRIAGE

[75] Inventor: Hong J. Kim, Suwon, Rep. of Korea

[73] Assignee: Samsung Electronics Co., Ltd., Suwon, Rep. of Korea

[21] Appl. No.: 540,743

[22] Filed: Oct. 11, 1995

Related U.S. Application Data

[63] Continuation of Ser. No. 54,759, Apr. 30, 1993, abandoned.

[30] Foreign Application Priority Data

Feb. 26, 1993 [KR] Rep. of Korea ..... 93-2981

[51] Int. Cl.[6] ..... B41J 19/30

[52] U.S. Cl. ..... 400/279; 400/323

[58] Field of Search ..... 400/279, 320, 400/322, 323, 903

[56] References Cited

U.S. PATENT DOCUMENTS 4,652,159 3/1987 Nagai ..... 400/322
4,733,981 3/1988 Takeuchi ..... 400/322
5,189,436 2/1993 Yoshikawa ..... 400/322
5,257,869 11/1993 Yoshikawa ..... 400/322

FOREIGN PATENT DOCUMENTS 61-22973 1/1986 Japan ..... 400/279

*Primary Examiner*—Edgar S. Burr
*Assistant Examiner*—Steven S. Kelley
*Attorney, Agent, or Firm*—Ladas & Parry

[57] ABSTRACT

A method for optimally controlling the carriage of a serial printer which is capable of printing line by line is disclosed. In controlling the carriage motor, until before the drive of the head, the carriage motor is controlled based on the head drive basic unit, i.e., steps of 1/360 inches, thereby making it possible to recognize the head fire position accurately. After the drive of the head, the carriage motor is controlled based on the carriage drive basic unit, i.e., steps of 1/120 inches, thereby reducing the number of interruptions in the central processing unit, and improving the system efficiency.

5 Claims, 4 Drawing Sheets

METHOD FOR OPTIMALLY CONTROLLING SERIAL PRINTER CARRIAGE

This application is a continuation of application Ser. No. 08/054,759, filed on Apr. 30, 1993, now abandoned.

FIELD OF THE INVENTION

The present invention relates to a serial printer drive method, and particularly to a method for optimally controlling a serial printer carriage. In the method, the carriage motor is controlled in the minimum head drive basic unit before driving the head, and thereafter, the motor is controlled in the minimum carriage drive basic unit, thereby improving the system efficiency.

BACKGROUND OF THE INVENTION

Generally, printers are classified as serial printers and page printers. A serial printer prints line by line, and included in this category are dot printers, thermal printers, ink jet printers and the like. A page printer prints page by page, and included in this category are laser printers.

The methods for driving the serial printer carriage are classified as two types. One type is to adopt the carriage drive basic unit per step drive as the criterion, while the other type is to adopt the head drive basic unit. In the case of a 24-pin printer, the carriage drive basic unit is 1/120 inches, while the head drive basic unit is 1/360 inches.

FIG. 1 is a block diagram showing the constitution of the usual serial printer. Referring to this drawing, a central processing unit (hereinafter termed "CPU") controls the overall operations of the printer, and contains a 16-bit counter by which the carriage drive time is decided. Further, the CPU stores a ROM memory device which can be externally provided in an alternative form.

A decoding circuit 10 connected to the CPU, controls the drive of a carriage drive section 20 or a head drive section 30 under the supervision of the CPU. That is, the decoding circuit 10 drives either the carriage drive section 20 or the head drive section 30.

Data buses which extend from the CPU are connected to the carriage drive section 20 and the head drive section 30, both of which receive various control data through the data buses.

If the carriage drive section 20 is selected by the decoding circuit 10 under the control of the CPU, it drives a carriage motor which is a step motor. If the head drive section 30 is selected by the decoding circuit 10 under the control of the CPU, it drives the head.

The conventional drive manner for the carriage and the head as described above judges the carriage drive time by means of a 16-bit counter which is installed within the CPU. If the relevant counting value corresponds to the carriage time table value, the CPU issues an interrupt. In such a case, the carriage is driven in accordance with the drive flow chart.

The carriage time table stored into the ROM within the CPU contains the drive values of the carriage motor such as time and distance.

The carriage drive flow chart is illustrated in FIG. 2, in which the carriage drive is carried out based on the head drive basic unit, and this method will be described below.

At first step S1, a judgment is made as to whether the carriage drive has forward direction. If it is judged that it has a forward direction, the head fire position is increased by 1, while if the carriage drive has a reverse direction, the head fire position is decreased by 1 (steps S2 and S3). The head fire position means that the position of the head lies at the printing position, and also that, in FIG. 3, the head moves from a font point A to a font point B. That is, the head moves from one font to another font, thereby printing a segment of a character.

Then it is determined as to whether it is in the current head fire position, i.e., the position to be printed, and if it is in the head fire position, the head is fired to print a character (steps S4 and S5). After step S5, the carriage count value for counting the movement of the carriage position based on the carriage drive basic unit, is decreased by 1 from the current carriage position count value. Then it is determined as to whether the carriage count value is 0. (steps S6 and S7).

If it is determined that the carriage count value is not 0 at step S7, the system is returned to step S1. If it is determined that the carriage count value is 0, an initial value is assigned to the carriage count value, and then, a determination is made as to whether the carriage is driven in the forward direction (steps S8 and S9). If it is determined that the carriage is driven in the forward direction at step S8, the current carriage position is increased by 1, while if it determined that the carriage is driven in the reverse direction, the current carriage position is decreased by 1 (steps S10 and S11).

After the completion of steps S10 and S11, the carriage is moved by a carriage drive basic unit, and a determination is made as to whether the carriage position lies within the constant speed region. That is, as to whether it lies within the region B in FIG. 4 (steps S12 and S13). If it is determined that the carriage position does not lie within the constant speed region at step S13, the carriage pointer is upgraded on the carriage time table, and then, the carriage count value is upgraded (steps S14 and S15), before returning to step S1. If it is determined that the carriage position lies within the constant speed region, the system is directly returned to step S1. The steps S5, S12, S14 and S15 are subroutine programs, and these are not shown.

The above described flow chart can be summarized as follows. When issuing a carriage interrupt, the CPU upgrades the head fire position, and the firing time is determined when the firing time is reached, the head is driven. Then the carriage position is upgraded, and the carriage count value is decreased by 1. If the value is 0, the carriage is moved by one step. Therefore as long as the carriage count value stays at 0, the interrupts have to be issued repeatedly, thereby lowering the system efficiency.

That is, the carriage drive is carried out based on the head fire basic unit, and therefore, in order to drive the carriage, the system has to be operated n (an integer) times before moving the carriage by 1 step, thereby resulting in lowering of the system efficiency.

SUMMARY OF THE INVENTION

The present invention is intended to give a solution to the above described problem.

It is an object of the present invention to provide a method for optimally controlling a printer carriage, in which the carriage motor is controlled based on the head drive basic unit until before the head is driven, so that the head fire position can be accurately known. The carriage motor is controlled based on the carriage drive basic unit after the drive of the head, thereby improving the system efficiency.

In achieving the above object, the method for optimally controlling a serial printer carriage according to the present invention includes steps of: determining as to whether the system is in a head fire mode; moving the head fire position by driving the carriage based on the carriage drive basic unit if it is head fire mode; and moving the head fire position by driving the carriage based on the head drive basic unit if it is judged at the first step that the system is not in the head fire mode.

BRIEF DESCRIPTION OF THE DRAWINGS

The object and other advantages of the present invention will become more apparent by describing in detail the preferred embodiment of the present invention with reference to the attached drawings in which.

DESCRIPTION OF THE PREFERRED EMBODIMENT

Figure 5A:
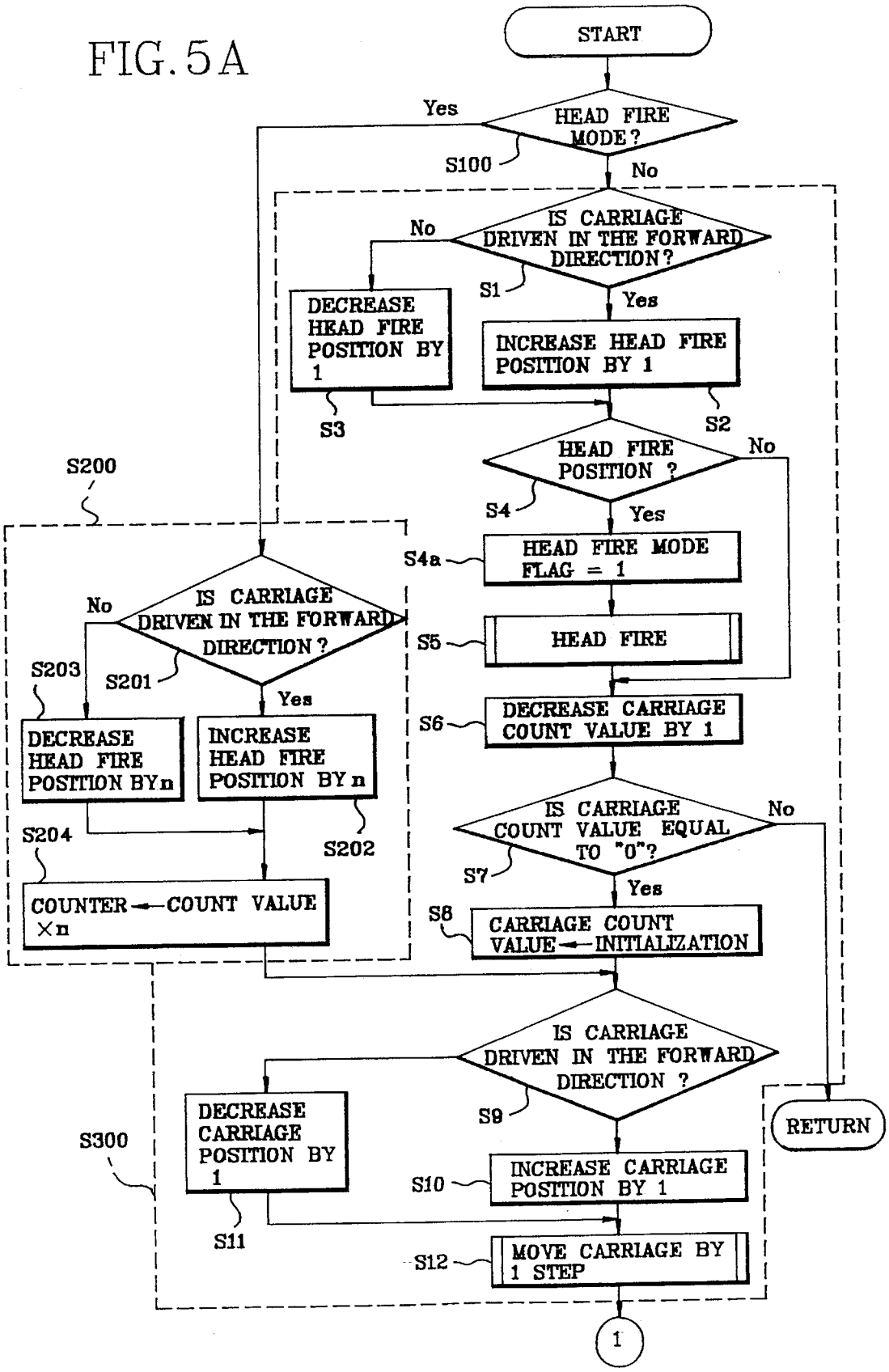
FIGS. 5A and 5B are flow charts showing the constitution of the method for optimally controlling a serial printer carriage according to the present invention.
Figure 5B:
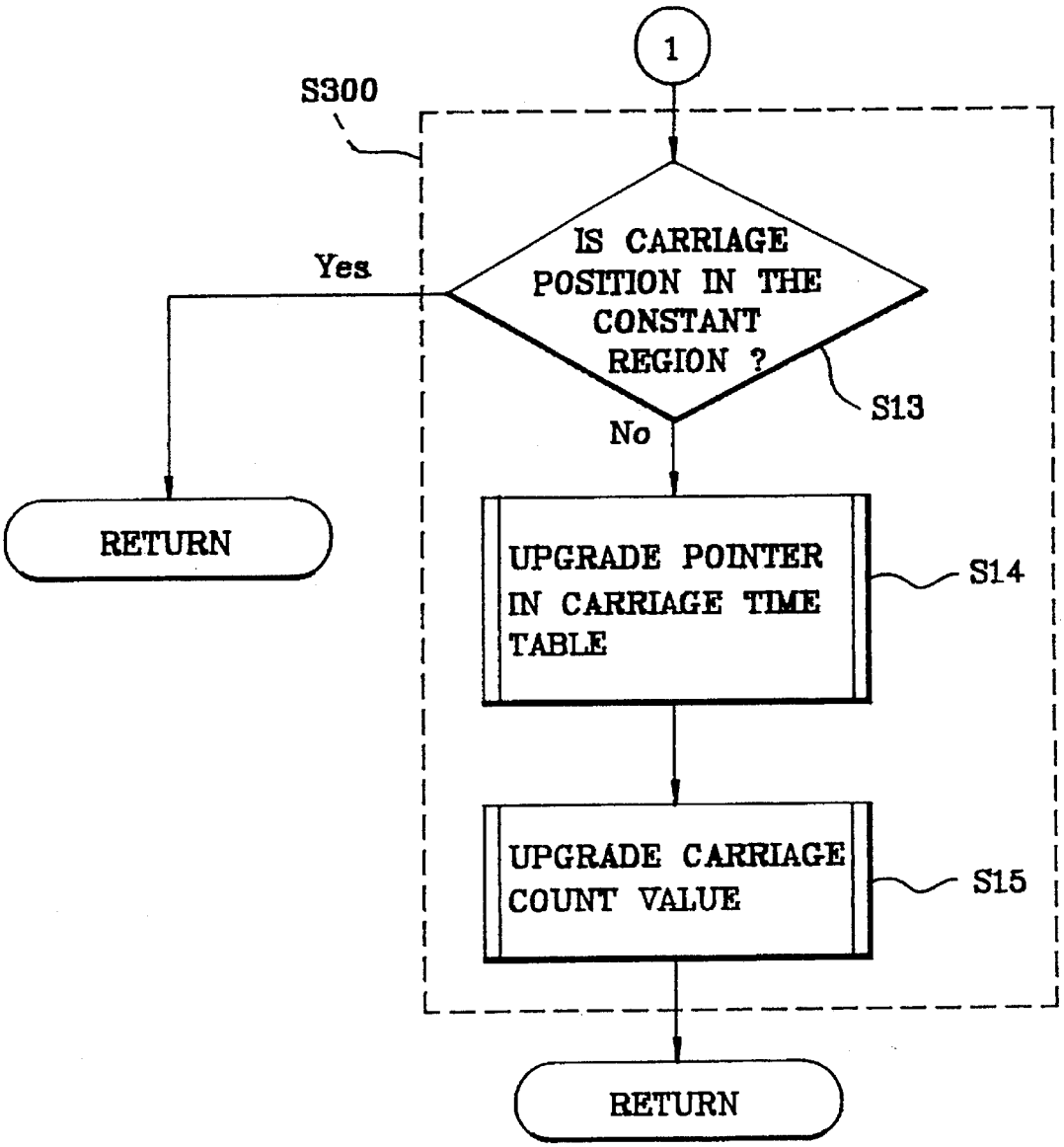

FIGS. 5A and 5B are flow charts for carrying out the method for optimally controlling a serial printer carriage according to the present invention. At step S100, a determination is made as to whether the system is in a head fire mode. If it is in a head fire mode at step S100, step S200 of moving the head fire position is carried out by driving the carriage based on the carriage drive basic unit. If it is judged that it is not under the head fire mode at step S100, step S300 of moving the head fire position is carried out by driving the carriage based on the head drive basic unit.

Step S200 includes a plurality of substeps. That is, a determination is made as to whether the carriage is driven in the forward direction (step S201), and then, if it is determined at step S201 that the carriage is driven in the forward direction, the head fire position is increased by 3 steps i.e. n=3 (step S202). If it is judged at the step S201 that the carriage is driven in the reverse direction, the head fire position is decreased by 3 steps (step S203). After carrying out steps S202 or S203, the count value is set to a value three times the current count value (step S204).

Figure 2:
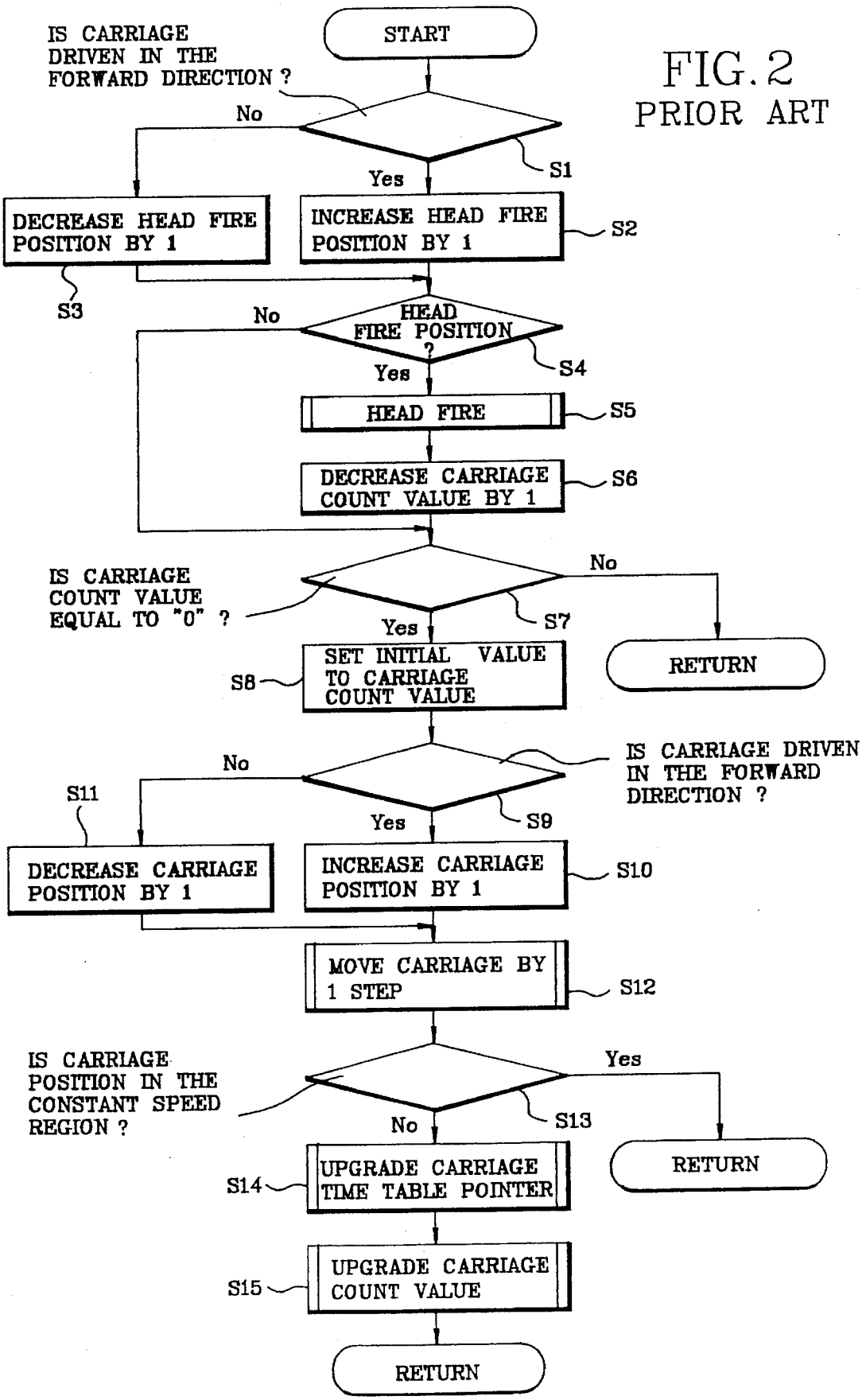
FIG. 2 PRIOR ART
FIG. 2 is a flow chart showing the constitution of the control method of a general serial printer carriage of the prior art.

Step S300 is same as that of FIG. 2, except that step S4a is added to it. That is, as shown in FIG. 2, between step S4 of determining as to whether the system is in the head fire position and step S5 of carrying out a head fire in the case of the head fire position, S4a is added in which the head fire mode flag is set to 1 in the case of the head fire position.

Figure 1:
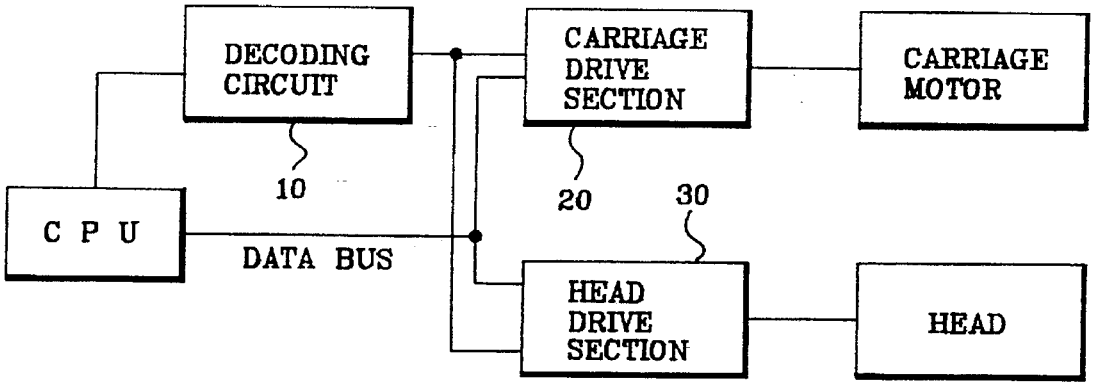
FIG. 1 PRIOR ART
FIG. 1 is a block diagram showing the constitution of a general serial printer of the prior art.
Figure 3:
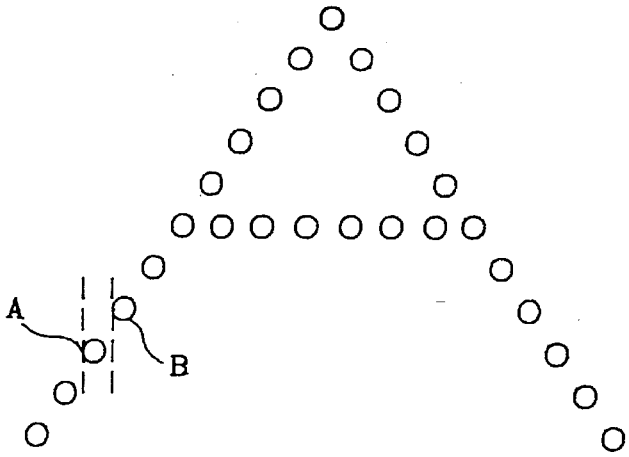
FIG. 3 illustrates the head fire.

The above described flow of the present invention is carried out to optimally control the drive of the carriage in a general serial printer which is illustrated in FIG. 1. The detailed operation of it will be described below.

The carriage interrupt is generated by using a 16-bit counter which is provided internally or externally to the CPU, while a reloading method is adopted. If the counting of the 16-bit counter reaches a certain value, the CPU generates an interrupt, and the CPU jumps to a carriage interrupt routine.

The carriage interrupt routine is classified into two flows: a head fire mode and a non-head fire mode. In the case of the head fire mode, step S200 of FIG. 5A is carried out to control the drive of the carriage, while, in the case of the non-head fire mode, step S300 is carried out to control the drive of the carriage, its procedure being as follows.

First, at step S100, a determination is made as to whether it is the head fire mode, i.e., as to whether it is the region for printing a character. This head fire mode is recognized if a head fire mode flag is set, and the head fire mode flag can be provided internally or externally to the CPU.

At step S100, if it is determined that it is not a head fire mode, that is, if the position does not lie in the constant speed region (B segment in FIG. 4), step S300 is carried out to drive the carriage motor based on the head drive basic unit, i.e., 1/360 inches.

Step S300 is the same as the conventional carriage drive method, and, in order to drive the carriage motor based on the head drive basic unit, a determination is made at step S1 as to whether the carriage is driven in the forward direction. If it is judged at step S1 that the carriage is driven in the forward direction, the head fire position is increased by 1. If it is judged that the carriage is driven in the reverse direction, the head fire position is decreased by 1 (steps S2 and S3). The increment and decrement are made based on the head drive basic unit, i.e., 1/360 inches.

Then a determination is made as to whether it is currently at the head fire position, and, if it is at the head fire position, then a head fire mode flag is set to 1 to carry out a head fire, thereby printing a character (steps S4, S4a and S5). Further, at step S5, parameters by which the different heads can fire are set, and firings are carried out. After carrying out step S5, the carriage count value is decreased by 1 from the current carriage count value, and then, a determination is made as to whether the carriage count value is 0 (steps S6 and S7).

If it is determined at step S7 that the carriage count value is not 0, the system is returned to step S1. If it is judged that the carriage count value is 0, then an initial value of n is set to the carriage count value, and then a determination is made as to whether the carriage is driven in the forward direction (steps S8 and S9). The value of n is 3, and the carriage drive basic unit (1/120 inches) equals the head drive basic unit (1/360 inches)×3.

If it is judged at step S8 that the carriage is driven in the forward direction, the current carriage position is increased by 1, while if it is judged that the carriage is driven in the reverse direction, the current carriage position is decreased by 1 (steps S10 and S11 ).

Figure 4:
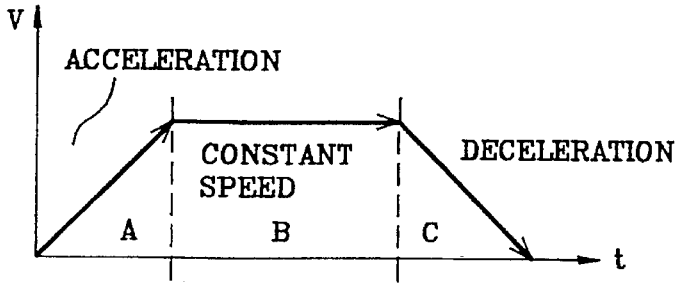
FIG. 4 illustrates the carriage drive region.

After carrying out steps S10 and S11, the carriage is moved as much as one carriage drive basic unit, and then, a determination is made as to whether the carriage is positioned in the constant speed region, that is, as to whether the carriage is positioned in the region B of FIG. 4 (steps S12 and S13). If it is judged at step S13, FIGS. 5A and 5B that the carriage is not positioned in the constant speed region, the carriage pointer is upgraded in the carriage time table, and the carriage count value is also upgraded (steps S14 and S15), the system then being returned to step S1. On the other hand, if it is judged at step S13 that the carriage is positioned in the constant speed region, the system is returned to step S1. Steps S5, S12, S14 and S15 are subroutine Program which are not shown in the drawings.

The above is the procedure for controlling the carriage motor with the head drive basic unit, i.e., 1/360 inches, until before setting the fire mode.

Meanwhile, in the next interrupt, if it is judged that a head fire mode flag has been set, the carriage drive direction is judged at step S201. If it is judged at step S201 that the carriage is driven in the forward direction, then the head fire position is increased by a value three times the head drive basic unit at step S202. If it is judged that the carriage is driven in the reverse direction, the head fire position is decreased by a value three times the head drive basic unit at step S203. Here the carriage fire position is increased or decreased by a value three times the head drive basic unit, because the carriage is intended to be moved in the unit of that much.

After carrying out steps S202 and S203, the current carriage value ×n (n=3) is set to the count value of the CPU at step S204, and then, steps S9–S15 are carried out to move the carriage motor by one step.

The above is the procedure for driving the carriage with the carriage drive basic unit.

According to the present invention as described above, the serial printer for printing line by line gives the following effects. Until the head is driven, the carriage motor is controlled based on the head drive basic unit, i.e., 1/360 inches, thereby making it possible to accurately recognize the head fire position. After the drive of the head, the carriage motor is controlled based on the carriage drive basic unit, i.e., 1/120 inches, so that the number of the interrupts of the CPU can be decreased, thereby improving the system efficiency. Further, the carriage drive speed during the firing mode is increased by three times.

What is claimed is:

1. A method for optimally controlling the carriage of a serial printer comprising the steps of driving a carriage step motor to move a carriage in successive steps at a substantially constant speed wherein said step of driving the carriage comprises driving said carriage motor at step intervals based on a head drive basic unit until a head is in a head fire mode and then driving said carriage motor based on a carriage drive basic unit at step intervals each n times greater than the step intervals before reaching said head fire mode.

2. A method for optimally controlling the carriage of a serial printer, comprising driving a carriage step motor at a substantially constant rate at different step intervals wherein said driving step comprises the steps of:

determining whether the system is in a head fire mode;

driving said carriage step motor at step intervals based on a carriage drive basic unit to move the head fire position upon finding the head fire mode in said determining step; and driving said carriage step motor at smaller step intervals at the same step rate based on a head drive basic unit to move the head fire position upon finding a no head fire mode in said determining step.

3. The method for optimally controlling the carriage of a serial printer as claimed in claim 2, wherein said driving step in the head fire mode comprises the substeps of:

determining whether said carriage is driven in the forward direction;

increasing said head fire position by n steps upon finding a forward drive direction of said carriage;

decreasing said head fire position by n steps upon finding a reverse drive direction of said carriage; and setting a counter value by n times the current count value where n is an integer representing the ratio of the step intervals of the carriage motor in the head fire mode and the no head fire mode.

4. The method for optimally controlling the carriage of a serial printer as claimed in claim 3, wherein the value of n is 3.

5. A method for optimally controlling the carriage of a serial printer comprising the steps of:

determining if a head of a serial printer is being driven;

driving a carriage motor controller based on a head drive basic unit to drive a carriage step motor in steps of 1/360" for accurately positioning a head in a head fire position if said head has not been driven; and driving the carriage motor controller based on a carriage drive basic unit to drive the carriage step motor in steps of 1/120" after the head has been driven.

* * * * *